US010087653B2

(12) United States Patent
Bullwinkel

(10) Patent No.: US 10,087,653 B2
(45) Date of Patent: Oct. 2, 2018

(54) LOST MOTION DRIVER FOR INTERCHANGEABLE CORE LOCK ASSEMBLIES

(71) Applicant: Delta Lock Company, LLC, Bohemia, NY (US)

(72) Inventor: William H. Bullwinkel, Farmingdale, NY (US)

(73) Assignee: Delta Lock Company, LLC, Bohemia, NY (US)

( * ) Notice: Subject to any disclaimer, the term of this patent is extended or adjusted under 35 U.S.C. 154(b) by 0 days.

(21) Appl. No.: 15/726,649

(22) Filed: Oct. 6, 2017

(65) Prior Publication Data

US 2018/0038132 A1 Feb. 8, 2018

Related U.S. Application Data

(63) Continuation of application No. 14/577,106, filed on Dec. 19, 2014, now Pat. No. 9,816,289.

(60) Provisional application No. 61/918,311, filed on Dec. 19, 2013.

(51) Int. Cl.

| | |
|---|---|
| ***E05B 65/44*** | (2006.01) |
| ***E05B 27/00*** | (2006.01) |
| ***E05B 15/00*** | (2006.01) |
| ***E05B 9/08*** | (2006.01) |
| ***E05C 3/04*** | (2006.01) |

(52) U.S. Cl.

CPC ..... *E05B 27/005* (2013.01); *E05B 9/084* (2013.01); *E05B 15/004* (2013.01); *E05B 15/0046* (2013.01); *E05C 3/042* (2013.01); *Y10T 70/7729* (2015.04)

(58) Field of Classification Search

CPC ..... E05B 27/005; E05B 9/084; E05B 15/004; E05B 15/0046; E05B 65/44; E05B 65/46; E05B 65/467; E05C 3/042; E05C 3/04; E05C 19/18; E05C 19/182; Y10T 70/7729; Y10T 70/5128; Y10T 70/5097

USPC ..... 70/367–369, 371, 14, 77–88, DIG. 42, 70/DIG. 62, DIG. 9, 95, 379 R, 379 A, 70/380; 292/256, 258, 288–298

See application file for complete search history.

(56) References Cited

U.S. PATENT DOCUMENTS

| | | | | | |
|---|---|---|---|---|---|
| 1,864,883 | A * | 6/1932 | Edward | E05C 19/182 | 292/296 |
| 2,140,066 | A * | 12/1938 | White | E05C 19/182 | 292/296 |
| 2,720,102 | A * | 10/1955 | Spain | E05C 19/182 | 70/131 |
| 3,262,292 | A * | 7/1966 | Glass | E05C 19/182 | 70/14 |
| 3,423,968 | A * | 1/1969 | Foote | E05C 19/182 | 70/14 |
| 3,563,593 | A * | 2/1971 | Leier | E05C 19/182 | 292/296 |
| 3,589,152 | A * | 6/1971 | Glass | E05B 63/0017 | 292/140 |

(Continued)

*Primary Examiner* — Lloyd A Gall

(74) *Attorney, Agent, or Firm* — Gerald E. Hespos; Michael J. Porco; Matthew T. Hespos

(57) ABSTRACT

Lock assemblies having cylinders with interchangeable cores are provided. In one embodiment a lock assembly comprises a cylinder including a keyway and a core. Also, the lock assembly includes a first driver operatively connected to the cylinder. In particular, key cuts of the core are changeable without removing the cylinder from the driver.

10 Claims, 14 Drawing Sheets

(56) References Cited

U.S. PATENT DOCUMENTS

| | | | | | |
|---|---|---|---|---|---|
| 4,356,580 | A | * | 11/1982 | Kurtz | E05B 65/0894 70/14 |
| 4,617,810 | A | * | 10/1986 | Fish | E05B 65/0894 70/14 |
| 4,630,457 | A | * | 12/1986 | Kincaid | E05B 9/086 70/337 |
| 4,672,827 | A | * | 6/1987 | Craig | E05B 9/086 70/367 |
| 4,899,563 | A | * | 2/1990 | Martin | E05B 9/084 70/367 |
| 4,920,774 | A | | 5/1990 | Martin | |
| 5,038,589 | A | | 8/1991 | Martin | |
| 5,101,649 | A | * | 4/1992 | Duval | E05B 9/086 70/369 |
| 5,121,619 | A | * | 6/1992 | Martin | E05B 9/084 70/369 |
| 5,315,850 | A | * | 5/1994 | Edeus | E05B 17/2053 292/153 |
| 5,657,652 | A | | 8/1997 | Martin | |
| 5,737,950 | A | | 4/1998 | Yun-Bin | |
| 6,035,673 | A | | 3/2000 | Harrison | |
| 6,920,770 | B2 | | 7/2005 | Lurie et al. | |
| 7,716,958 | B2 | | 5/2010 | Martin | |
| 7,874,189 | B2 | | 1/2011 | Martin | |
| 7,895,867 | B2 | | 3/2011 | Hsieh | |
| 8,028,555 | B2 | | 10/2011 | Lurie | |
| 8,776,557 | B2 | | 7/2014 | Wang | |
| 8,919,156 | B1 | | 12/2014 | Liu | |
| 8,978,426 | B2 | | 3/2015 | Wang | |
| 9,816,289 | B2 | * | 11/2017 | Bullwinkel | E05B 27/005 |
| 2005/0011239 | A1 | | 1/2005 | Lurie et al. | |
| 2006/0086162 | A1 | | 4/2006 | Huang | |
| 2007/0227209 | A1 | | 10/2007 | Massard et al. | |
| 2009/0071209 | A1 | | 3/2009 | Lurie | |
| 2010/0031717 | A1 | | 2/2010 | Lurie et al. | |

* cited by examiner

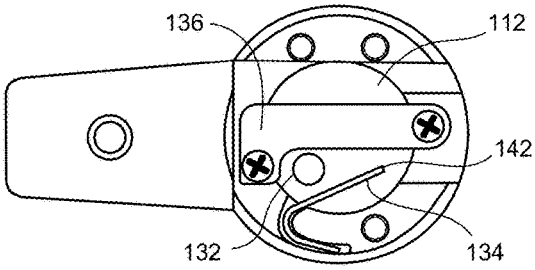
FIG. 18A
FIG. 18B
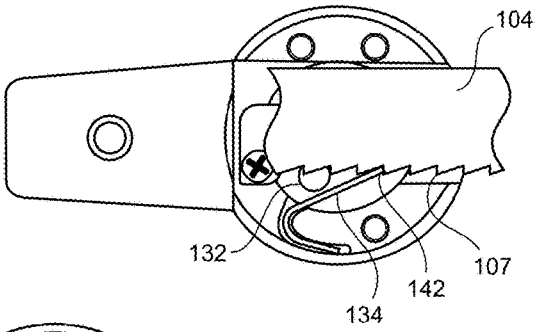
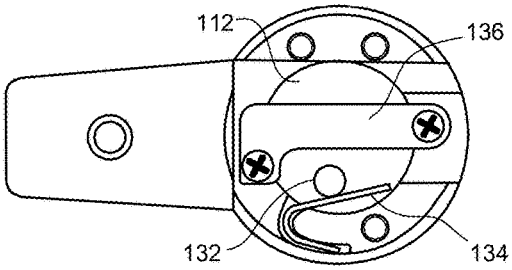
FIG. 18C
FIG. 18D
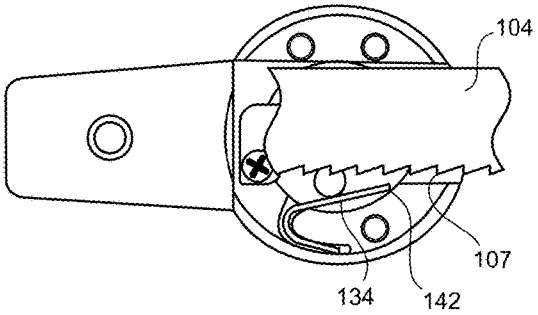

LOST MOTION DRIVER FOR INTERCHANGEABLE CORE LOCK ASSEMBLIES

CROSS-REFERENCE TO RELATED APPLICATIONS

This application is a continuation application of U.S. application Ser. No. 14/577,106, filed Dec. 19, 2014, now U.S. Pat. No. 9,816,289,which claims the benefit under 35 U.S.C. § 119 of U.S. Provisional Application No. 61/918,311, filed on Dec. 19, 2013, the entire disclosure of which is incorporated by reference herein.

TECHNICAL FIELD

The present disclosure relates generally to lock mechanisms, and more particularly, to lock assemblies for use with lock cylinders of interchangeable core cylinder types.

BACKGROUND

Numerous types of cylinders for locks are known and popularly used for various applications. For example, locks known in the industry as "interchangeable core cylinder" locks are used to provide a lock wherein the core cylinder can be removed from the lock housing through the use of a control key. A different interchangeable core cylinder can then be inserted into the lock housing, whereby the user can quickly and easily change a lock or locks without calling a locksmith.

Certain types of interchangeable core cylinders allow the same core to be rekeyed and reused for a predetermined number of rekeying procedures. However, for the rekeying procedure, the control key must be rotated at least 180 degrees. Currently, multiple small format interchangeable core (SFIC) showcase and cabinet lock housings only turn about 90 degrees due to internal lock mechanisms. Typically, this means the interchangeable core cylinder must be removed from the locking assembly, rekeyed to accommodate a new key and then re-installed in the locking assembly, increasing the time and complexity of the rekeying process.

Therefore, a need exists for interchangeable core lock assemblies that can be rekeyed without removing the interchangeable core cylinder from the lock assembly.

SUMMARY

Lock assemblies for use with lock cylinders of interchangeable core cylinder types are provided. Embodiments of the present disclosure provide the ability for both an operating key and a rekeying key to turn 180 degrees to unlock and lock. The rekeying key enables the interchangeable core to be changed to a different set of key cuts to operate with a new operating key compared with a previous operating key used to operate the core installed in the lock housing without the necessity of changing to a differently keyed core.

In one implementation, a lock assembly comprises a housing, a cylinder, and a driver. The housing includes at least one cylindrical bore. The cylinder is mounted within the at least one cylindrical bore of the housing. The cylinder includes a keyway and an interchangeable core. The driver is at least partially mounted within the housing and is operatively connected to the cylinder. The driver includes a first part configured to rotate at least about 180 degrees and the interchangeable core is configured to be rekeyed while remaining in the housing.

In another implementation, a lock assembly comprises a cylinder including a keyway and a core. Also, the lock assembly includes a first driver operatively connected to the cylinder. In particular, key cuts of the core are changeable without removing the cylinder from the driver.

BRIEF DESCRIPTION OF THE DRAWINGS

The above and other aspects, features, and advantages of the present disclosure will become more apparent in light of the following detailed description when taken in conjunction with the accompanying drawings in which:

FIGS. 18A-D illustrate bottom views of the ratchet type locking assembly of FIG. 14 in operation in accordance with the present disclosure;

Figure 1:
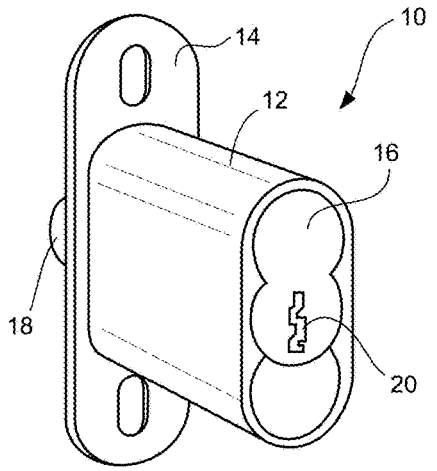
FIG. 1 is a perspective view of a plunger type locking assembly in accordance with an embodiment of the present disclosure.
Figure 2:
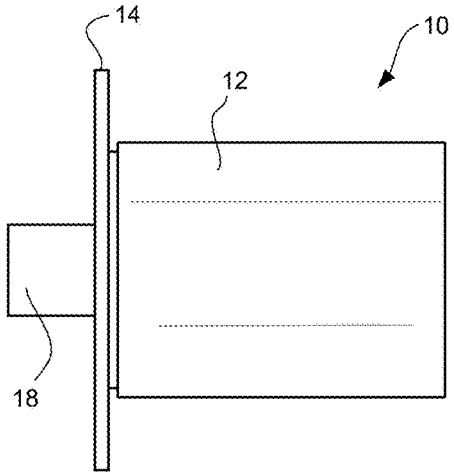
FIG. 2 is a side view of the plunger type locking assembly of FIG. 1 in accordance with an embodiment of the present disclosure.

It should be understood that the drawings are for purposes of illustrating the concepts of the disclosure and are not necessarily the only possible configuration for illustrating the disclosure.

DETAILED DESCRIPTION

Preferred embodiments of the present disclosure will be described hereinbelow with reference to the accompanying drawings. In the following description, well-known functions or constructions are not described in detail to avoid obscuring the present disclosure in unnecessary detail.

Referring to FIGS. 1-4, a lock assembly 10 of the "interchangeable core" type is generally depicted. The lock assembly 10 shown may also be referred to as a plunger type lock assembly. It is to be appreciated that the teachings of the present disclosure may apply to other types of locks including drawer locks, showcase locks, cam locks, latch locks, padlocks, etc. The lock assembly 10 includes a housing 12, an assembly plate 14 and an interchangeable core cylinder 16 disposed in the housing 12. The interchangeable core cylinder 16 is placed in the housing 12 and has a shape similar to that of two intersecting cylinders. As is known in the art, the upper cylinder 44 generally houses a pin structure of the lock, while the lower cylinder 46 accommodates the keyway 20 of the lock. The pin structure of upper cylinder 44 extends into the keyway of lower cylinder 46 to provide locking action.

Typically, the interchangeable core cylinder 16 has a locking lug (not shown) which holds the cylinder in place in the housing and which, as is known in the art, is actuated by a control key (not shown) to remove the interchangeable core cylinder 16 from the housing 12 of the lock. The locking lug is disposed against a ledge means which is provided in the housing 12 for use with the interchangeable core cylinder 16. When the interchangeable core cylinder 16 is to be removed, the control key is used which withdraws the locking lug into the interchangeable core cylinder 16 and allows the cylinder 16 to be pulled out of the housing 12. In an operation mode, an operating key is disposed in the keyway 20 to actuate a bolt 18 for locking and unlocking the lock assembly 10.

Figure 3:
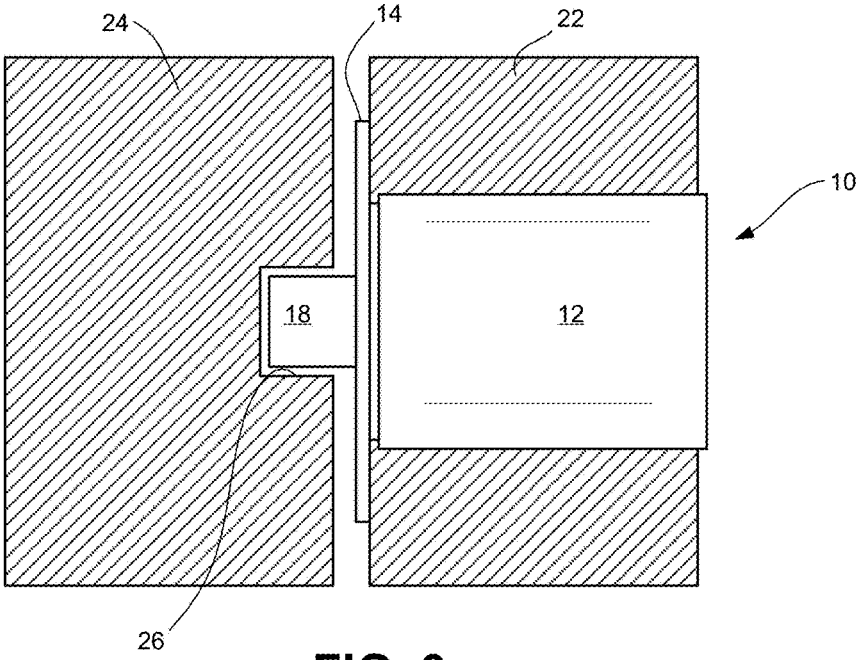
FIG. 3 is a side view of the plunger type locking assembly of FIG. 1 installed in a support structure.

Referring to FIG. 3, the lock assembly 10 may be mounted in a support structure 22, e.g., a door, door jamb, etc. When the lock assembly 10 is actuated into a locked position, the bolt 18 extends from a rear surface of the assembly plate 14 into a cavity 26 of a receiving structure 24.

Figure 4:
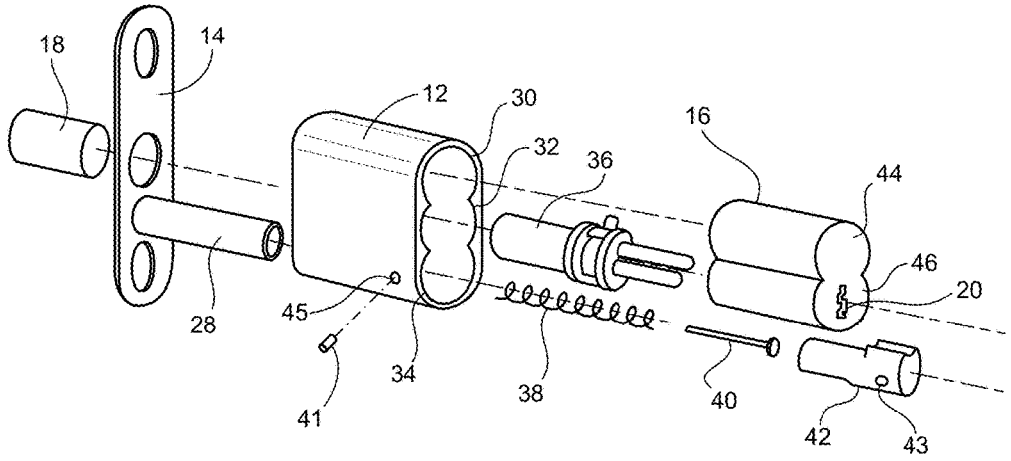
FIG. 4 is an exploded view of a plunger type locking assembly in accordance with an embodiment of the present disclosure.
Figure 5:
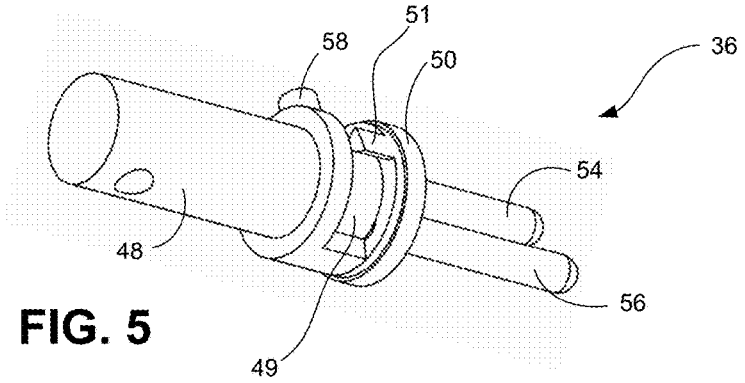
FIG. 5 is a perspective view of a driver employed in the plunger type locking assembly of FIG. 4 in accordance with an embodiment of the present disclosure.
Figure 6:
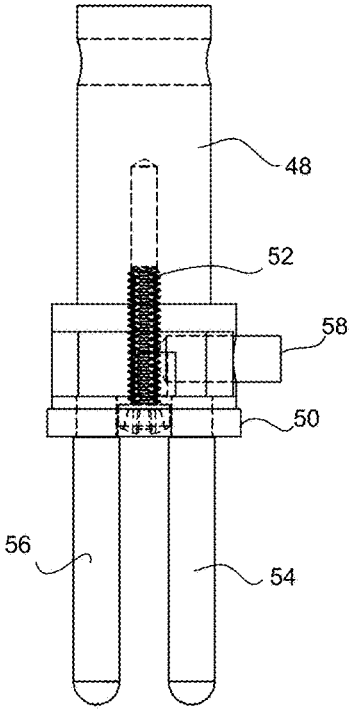
FIG. 6 is a cross sectional view of the driver of FIG. 5 employed in the plunger type locking assembly in accordance with an embodiment of the present disclosure.
Figure 7:
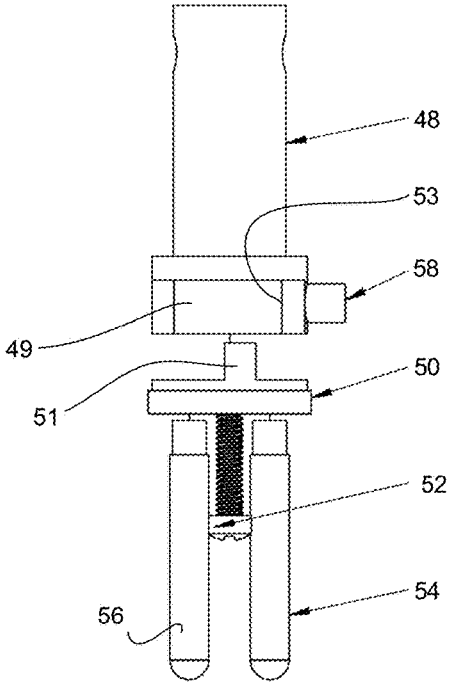
FIG. 7 is an exploded view of the driver of FIG. 5 employed in the plunger type locking assembly in accordance with an embodiment of the present disclosure.
Figure 8:
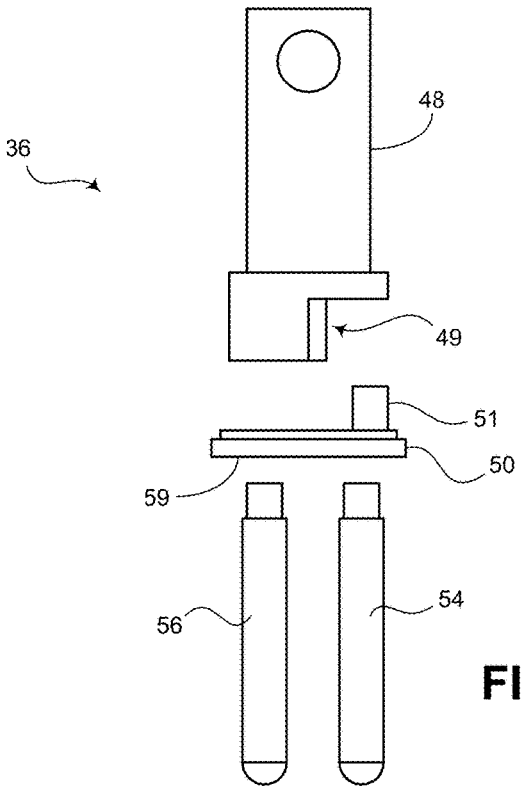
FIG. 8 is another exploded view of the driver of FIG. 5 employed in the plunger type locking assembly in accordance with an embodiment of the present disclosure.
Figure 9A:
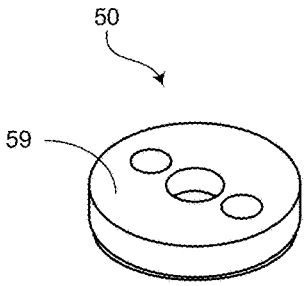
FIG. 9A is a perspective view of a drive slab employed in the driver of FIG. 5 in accordance with an embodiment of the present disclosure.
Figure 9B:
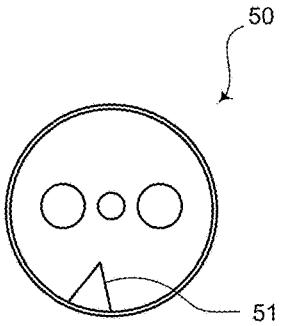
FIG. 9B is a top view of the drive slab shown in FIG. 9A.

Referring to FIG. 4, an exploded view of the lock assembly 10 in accordance with the present disclosure is illustrated. The housing 12 includes an upper bore 30, a middle bore 32 and a lower bore 34. The upper bore 30 and middle bore 32 are configured to receive the interchangeable core cylinder 16. The lower bore 34 is configured to be disposed over a receiving member 28 coupled to the assembly plate 14. Spring 38, pin 40, and fastener member 42 are coupled to the receiving member 28 to actuate the assembly plate 14 for unlocking the assembly 10, details of which will be described below. Fastener member 42 is secured to the housing 12 via pin 41 when aperture 43 of fastener member 42 aligns with aperture 45 of the housing 12.

A driver 36, e.g., a lost motion driver, provides a transmission force from the interchangeable core cylinder 16 to the bolt 18. Referring to FIGS. 5-10D, the driver 36 is illustrated in more detail. The driver 36 includes a rod portion 48 which is rotatably mounted to a drive slab 50 via, for example, a screw 52. Additionally, the screw 52 enables the rod portion 48 to be spaced apart from the drive slab 50 at different distances to accommodate different size locks and/or housings. The drive slab 50 includes a first prong or stud 54 and a second prong or stud 56 extending from a lower surface 59 of the drive slab 50. The first and second prongs 54, 56 are inserted into receiving apertures (not shown) disposed on a rear surface of the lower cylinder 46 of the interchangeable core cylinder 16. The rod portion 48 of the driver 36 is coupled to the bolt 18 in such a manner that when a key is inserted into keyway 20 and rotated, the prongs 54, 56 of the driver 36 are rotated which in turn drives the rod portion 48 to extend the bolt 18.

By rotatably mounting the rod portion 48 to the drive slab 50, a rekeying key disposed in the keyway 20 may turn 180 degrees allowing for rekeying of the interchangeable core 16 without removing the core from the housing 12. It is to be appreciated that an operating key also has a range of motion of 180 degrees to actuate the bolt 18. The 180 degree rotation is enabled by providing an undercut 49 in a lower portion of the rod 48. A post 51 of the drive slab 50 moves within the undercut 49 as the prongs 54, 56 are rotated via a key inserted into the core 16. The post 51 rides within the undercut 49 to give the driver 36 the lost motion needed to allow the driver 36 to work 180 degrees, i.e., the rod portion 48 does not rotate while the post 51 rides freely in the undercut.

Figure 10A:
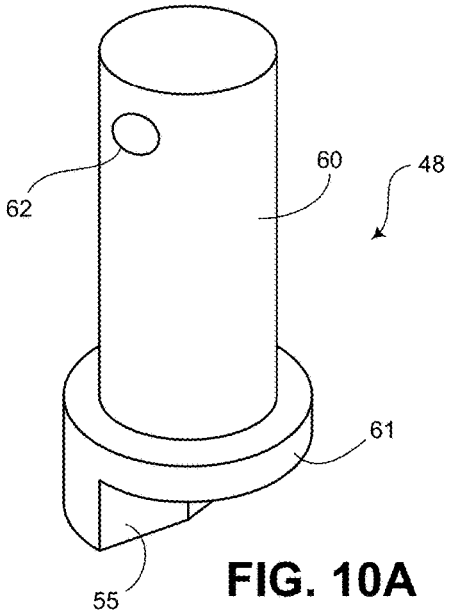
FIG. 10A is a perspective view of a rod employed in the driver of FIG. 5 in accordance with an embodiment of the present disclosure.
Figure 10B:
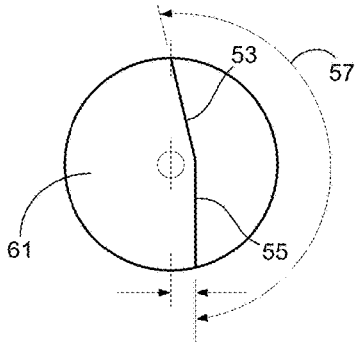
FIG. 10B is a bottom view of the rod shown in FIG. 10A.
Figure 10C:
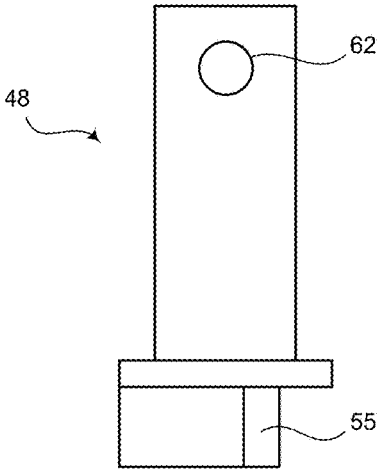
FIG. 10C is a left side view of the rod shown in FIG. 10A.
Figure 10D:
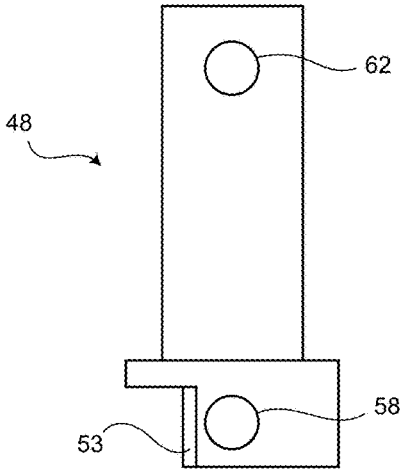
FIG. 10D is a right side view of the rod shown in FIG. 10A.

As the front part of the driver 36 moves (i.e., the prongs 54, 56 being rotated via a key), the post 51 of the driver 36 will move within an arc 57 (as shown in FIG. 10B) of the undercut 49 of the rod portion 48 from a first end 55 of the undercut 49 until the post 51 makes contact with the stopping point at a second end 53 of the undercut 49. Then, the rest of the driver 36 is allowed to move to release the sleeve contact with the outer mounting plate. It is to be appreciated that the arc 57 defined by ends 53, 55 is approximately 193 degrees, however, other arc lengths are contemplated to be within the scope of the present disclosure.

A pin 58 is used for the actual rotation of the rod 48. When assembled, the bolt 18 is disposed over an upper portion 60 of the rod 48. The bolt 18 is secured to the upper portion 60 via, for example, a set screw which is coupled to aperture 62. The pin 58 will make contact with the inside of the lock housing to control the range of rotation of the rod 48 and the bolt 18. This is what allows the lock to open.

Figure 11A:
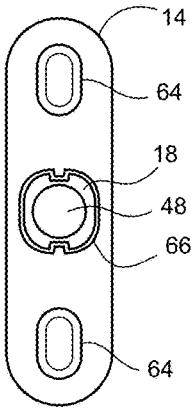
FIGS. 11A-C illustrate a back view, side view, and front view, respectively, of the plunger type locking assembly of FIG. 4 in an unlocked state in accordance with an embodiment of the present disclosure.
Figure 11B:
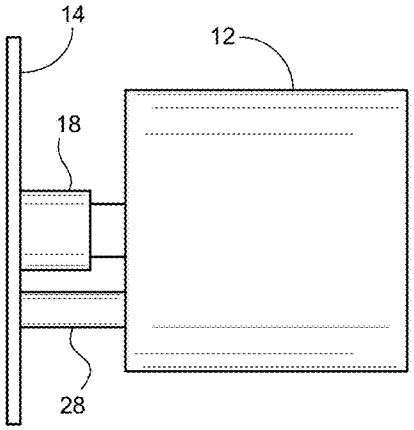
Figure 11C:
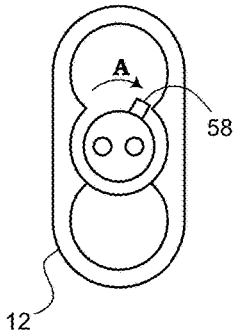
Figure 12A:
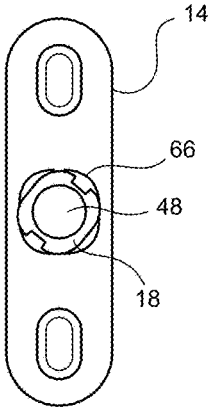
FIGS. 12A-C illustrate a back view, side view, and front view, respectively, of the plunger type locking assembly of FIG. 4 in a locked state in accordance with an embodiment of the present disclosure.
Figure 12B:
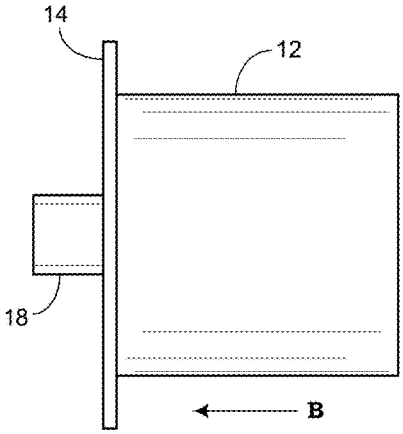
Figure 12C:
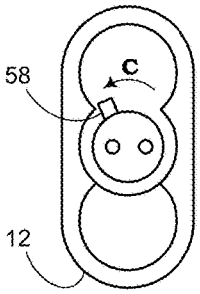

Referring to FIGS. 11 and 12, operation of the locking assembly 10 is illustrated, where FIGS. 11A-11C illustrate an unlocked state and FIGS. 12A-12C illustrate a locked state. FIG. 11A illustrates a rear view of the assembly plate 14. Assembly plate 14 includes two apertures 64 for receiving screws to secure the assembly plate 14 to support structure 22. The plate 14 further includes a bolt aperture 66 which is configured to have the same shape as the peripheral shape of bolt 18. In the unlocking state as shown in FIG. 11B, the plate 14 is biased away from the housing 12 via spring 38 interacting with receiving member 28. Referring to FIG. 11C where the core 16 has been removed to illustrate the motion of the driver 36, the pin 58 makes contact with a first side of an inner surface of housing 12 to prevent the pin 58 from further traveling in direction A.

To place the locking assembly 10 into the locked position, the housing 12 is pushed toward the plate 14 in the direction of arrow B shown in FIG. 12B. As shown in FIG. 12B, the bolt 18 extends outward from the plate 14 until the housing 12 comes into contact with plate 14. A key placed in the keyway 20 of core cylinder 16 is then employed to lock the bolt 18 in place. By rotating the key in the counter-clockwise direction, the prongs 54, 56 of the driver 36 will rotate in the direction of arrow C, as shown in FIG. 12C. The drive slab 50 will rotate until post 51 comes into contact with end 55. Upon the post 51 contacting end 55, the rod portion 48 will then rotate in the counter-clockwise direction until pin 58 contacts a second side of the inner surface of housing 12. The rotation of the rod portion 48 causes the bolt 18 to rotate so the outer periphery of the bolt 18 does not align with aperture 66 to prevent the plate 14 from being biased away from the housing 12, thus locking the bolt 18 in place.

It is to be appreciated that the housing 12 may be configured in shapes other then that shown in FIG. 1. For example, the housing may be configured in a substantially cylindrical shape when, for example, the cylindrical lock is employed as a glass mount plunger lock. It is further to be appreciated that the rod and bolt may be configured in various other shapes to achieve the teachings of the present disclosure, for example, circular, hex, square rectangular, etc. In one embodiment, the bolt may be configured as a "T" bolt.

Figure 13A:
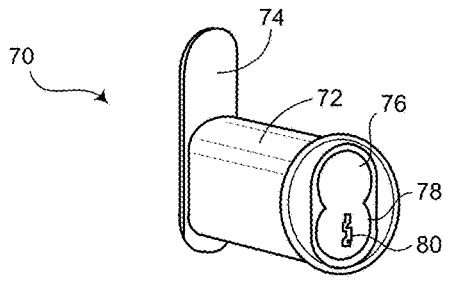
FIG. 13A is a perspective view of a cam lock in accordance with an embodiment of the present disclosure.
Figure 13B:
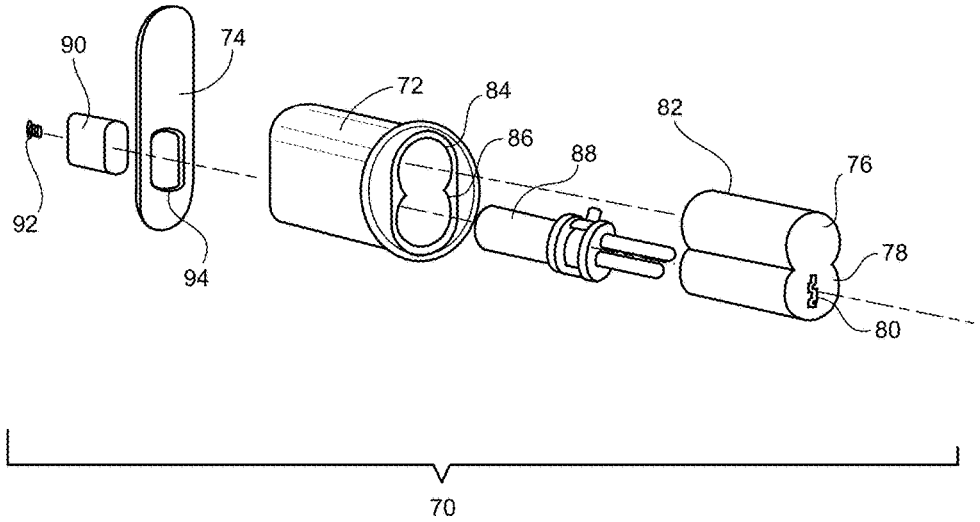
FIG. 13B is an exploded view of the cam lock of FIG. 13A.

FIGS. 13A and 13B illustrate another embodiment of a lock assembly 70 according to the teaching of the present disclosure, where FIG. 13A is a perspective view and FIG. 13B is an exploded view. The lock assembly 70 has an "interchangeable core" and is configured as a cam lock. According to other embodiments, the lock assembly 70 may be used as showcase locks, cabinet locks, drawer locks, latch locks, etc. The lock assembly 70 includes a housing 72, a cam 74 and an interchangeable core cylinder 82 disposed in the housing 72. The interchangeable core cylinder 82 is placed in the housing 72 and has a shape similar to that of two intersecting cylinders. The upper cylinder 76 generally houses a pin structure of the lock assembly 70, while the lower cylinder 78 accommodates a keyway 80 of the lock. The pin structure of upper cylinder 76 extends into the keyway 80 of lower cylinder 78 to provide locking action.

The interchangeable core cylinder 82 may include a locking lug (not shown) which holds the cylinder in place in the housing and which, as is known in the art, is actuated by a control key (not shown) to remove the interchangeable core cylinder 82 from the housing 72 of the lock. The locking lug may be disposed against a ledge which is provided in the housing 72 for use with the interchangeable core cylinder 82. When the interchangeable core cylinder 82 is to be removed, the control key is used which withdraws the locking lug into the interchangeable core cylinder 82 and allows the cylinder 82 to be pulled out of the housing 72.

In an operation mode, an operating key is disposed in the keyway 80 to actuate a bolt 90 connected to the cam 74. Rotation of the cam 74 allows for locking and unlocking of the lock assembly 70. In some embodiments, the lock assembly 70 may be mounted in a structure (e.g., an entry door, a cabinet door, a drawer, a sliding showcase door, etc.). When the lock assembly 70 is actuated into a locked position, the cam 74 is rotated into a slot of a frame structure (not shown). To unlock the lock assembly 70, the cam 74 is rotated in the opposite direction until it is outside the slot.

Referring to FIG. 13B, an exploded view of the lock assembly 70 in accordance with the present disclosure is illustrated. The housing 72 includes an upper bore 84 and a lower bore 86. The upper bore 84 and lower bore 86 are configured to receive the interchangeable core cylinder 82. One or more springs, pins, and fastening members (not shown) may be used to hold a driver 88 within the lower bore.

The driver 88 may be a lost motion driver and may be configured like driver 36 shown in FIGS. 5-10. The driver 88 is configured to provide a transmission force from the interchangeable core cylinder 82 to the bolt 90 and cam 74. The driver 88 may include two prongs that are inserted into apertures disposed in a rear surface of the lower cylinder 78 of the interchangeable core cylinder 82. A rod portion of the driver 88 is coupled to the bolt 90 using screw 92. The bolt 90 is attached to cam 74 through aperture 94. When a properly-keyed key is inserted into keyway 80 and rotated, the prongs of the driver 88 are rotated, which in turn rotates the rod portion of the driver 88, which in turn rotates the bolt 90 that is connected to the cam 74.

The lock assembly 70 of FIG. 13 is configured such that when a rekeying key is disposed in the keyway 80, the rekeying key may turn 180 degrees allowing for rekeying of the interchangeable core 82 without removing the core from the housing 72. It is to be appreciated that an operating key to be used with the lock assembly 70 also has a range of motion of 180 degrees to actuate the cam 74. The driver 88 may be configured similar to the driver 36 shown in FIGS. 5-10 to allow for the 180 degree rotation of rekeying key and operating key.

It is to be appreciated that the housing 72 may be configured in shapes other then that shown in FIG. 13A. In one embodiment, the housing 72 may include a threaded surface on its cylindrical body where a barrel nut may be employed to secure the housing 72 to a support structure. It is further to be appreciated that the rod portion of driver 88 and bolt 90 may be configured in various other shapes to achieve the teachings of the present disclosure, for example, circular, hex, square rectangular, etc.

Figure 14:
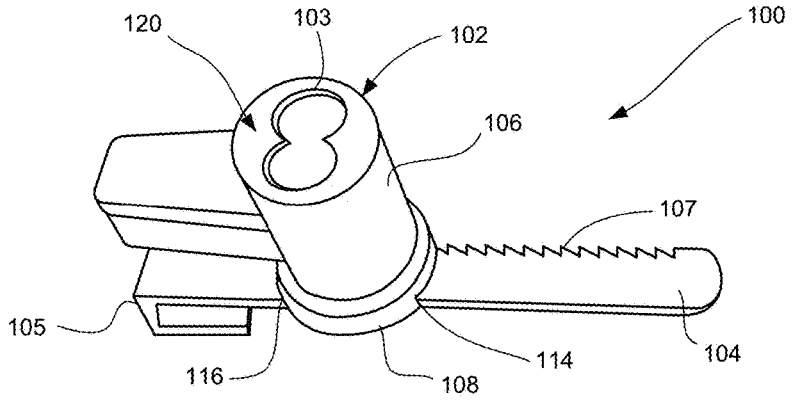
FIG. 14 is a front perspective view of a ratchet type locking assembly in accordance with an embodiment of the present disclosure.
Figure 15:
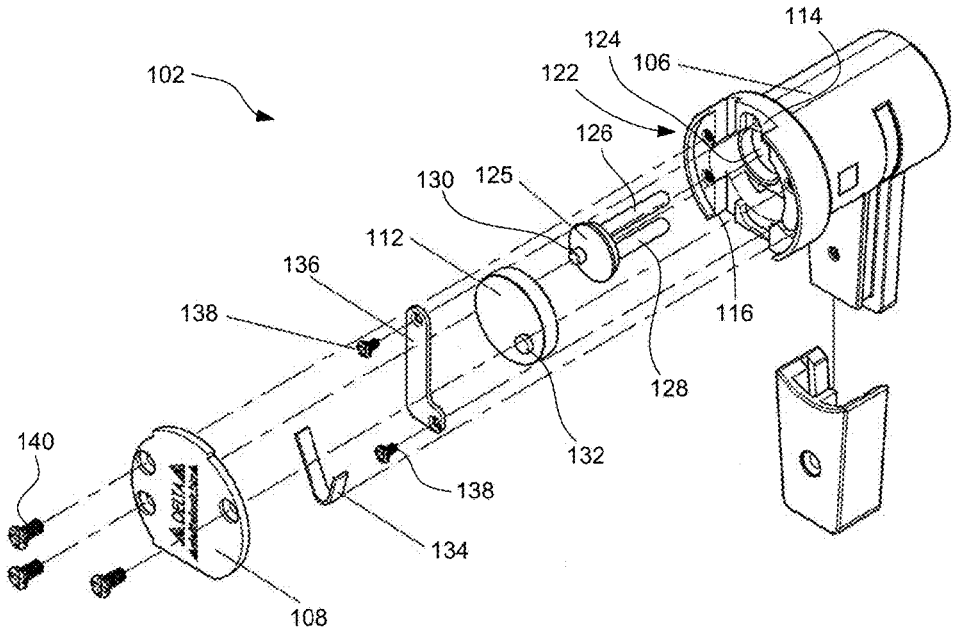
FIG. 15 is an exploded view of the ratchet type locking assembly of FIG. 14 in accordance with an embodiment of the present disclosure.

Referring to FIGS. 14 and 15, a ratchet lock assembly 100 of the "interchangeable core" type is generally depicted. The lock assembly 100 includes a lock mechanism 102 and locking bar 104. The locking bar 104 is formed with a hook 105 on one end and a serrated edge 107 on the other end for engaging a mechanism internal to the lock mechanism 102, as will be described below. The lock mechanism 102 includes a housing 106 having a front surface 120 configured to receive an interchangeable core cylinder (not shown) in aperture 103, i.e., the interchangeable core cylinder is front-loaded.

The rear portion 122 of housing 106 includes a bore 124 configured to receive a first driver 125. The first driver 125 includes first and second prongs 126, 128 to be coupled with the interchangeable core cylinder disposed in the housing 106. The first driver 125 further includes a first cam 130 for providing a transmission force to a second driver 112. As will be described in relation to FIG. 17, the second driver 112 includes a groove or channel on a rear surface configured to accept the first cam 130. The second driver 112 further includes a second cam 132 for actuating spring 134 which is configured to engage the serrated edge 107 of the locking bar 104. A bracket 136 secures the first and second drivers 125, 112 into the housing 106 via screws 138. An end plate 108 is coupled to the housing 106 via screws 140. It is to be appreciated that the rear portion 122 of the housing includes first and second recesses 114, 116 to allow the locking bar 104 to pass through the lock mechanism 102 when fully assembled.

Figure 16A:
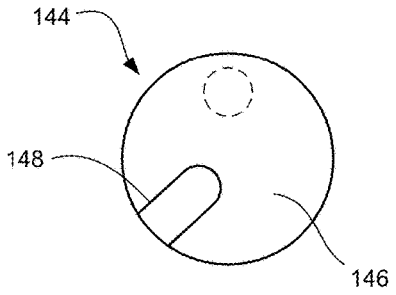
FIGS. 16A-C illustrate a top view, bottom view, and side view, respectively, of a conventional driver for a ratchet type locking assembly.
Figure 16B:
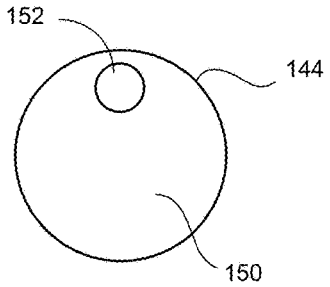
Figure 16C:
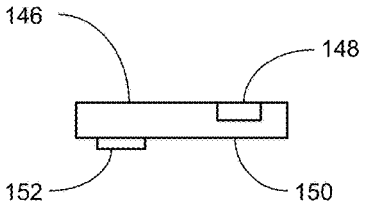

Referring to FIGS. 16A-16C, a second driver 144 is illustrated. Driver 144 includes a first surface 146 having a groove or channel 148 and a second surface 150 including a cam 152. In operation, the first cam 130 of first driver 125 will ride in channel 148 to actuate the driver 144 in a rotatable motion. The rotation of the driver 144 causes cam 152 to rotate and engage spring 134. However, due to the shape of the channel 148, the first driver 125 may only rotate approximately 45 degrees which subsequently limits the motion of the key to approximately the same range. Due to its limited motion, the only way to rekey the interchangeable core cylinder would be to remove it.

Figure 17A:
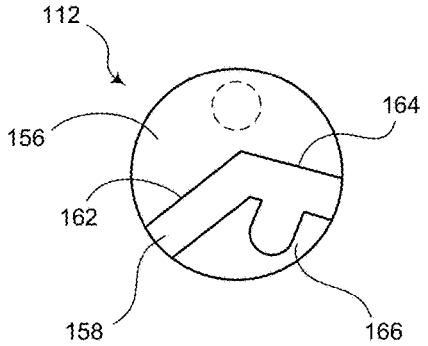
FIGS. 17A-C illustrate a top view, bottom view, and side view, respectively, of a driver for the ratchet type locking assembly of FIG. 14 in accordance with the present disclosure.
Figure 17B:
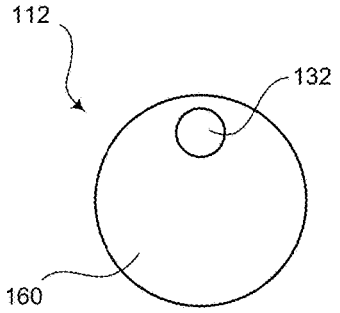
Figure 17C:
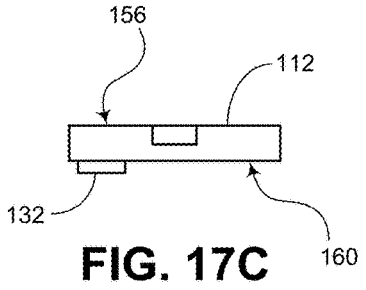

By providing the second driver 112 in accordance with the present disclosure as shown in FIGS. 17A-17C, the motion, or rotation, of the control key disposed in a keyway of the interchangeable core cylinder is extended to approximately 180 degrees. Referring to FIGS. 17A-17C, the second driver 112 includes a first surface 156 having a groove or channel 158 and a second surface 160 including the second cam 132. In operation, the first cam 130 of first driver 125 will ride in channel 158 to actuate the second driver 112 in a rotatable motion. As can be seen in FIG. 17A, channel 158 includes a first leg 162 joined by a second leg 164 at a predetermined angle, e.g., an angle of about 125 degrees. The second leg 164 includes a notch 166. The notch 166 is provided to give clearance to the first cam 130 that is moving in the channel 158, therefore allowing the first cam 130 to move freely in the channel 158 to not lock up inside causing a lockout issue. By providing such a channel 158, the second cam 132 will rotate the same distance as the cam 152 of driver 144; however, the first cam 130 will travel a longer distance in channel 158 allowing the first driver 125 to rotate about 180 degrees; thus, the key may also rotate 180 degrees. By allowing the keyway of the lower cylinder to rotate about 180 degrees, the interchangeable core may be rekeyed without removing the core from the housing. In the various embodiments of the present disclosure, the operating key and the rekeying key will both move at least about 180 degrees.

Referring to FIGS. 18A-18D, several views of the operation of the second driver 112 are illustrated, where FIGS. 18A and 18C illustrate operation of the driver 112 with the locking bar 104 removed and FIGS. 18B and 18D illustrate operation with the locking bar in place. A view of the locked state is shown in FIGS. 18A and 18B, which illustrate an unbiased position of the spring 134. In this position, the second cam 132 is not touching the spring and an edge 142 of the spring 134 is in position to selectively engage the serrated edge 107 of the locking bar 104. As the key cylinder of the interchangeable core cylinder is rotated, the second cam 132 engages the spring 134, as shown in FIGS. 18C and 18D, to lift the edge 142 of the spring 134 from the serrated edge 107, allowing unlocking of the locking mechanism. This allows free movement of the locking bar 104 to withdraw the locking bar from the locking mechanism.

Figure 19:
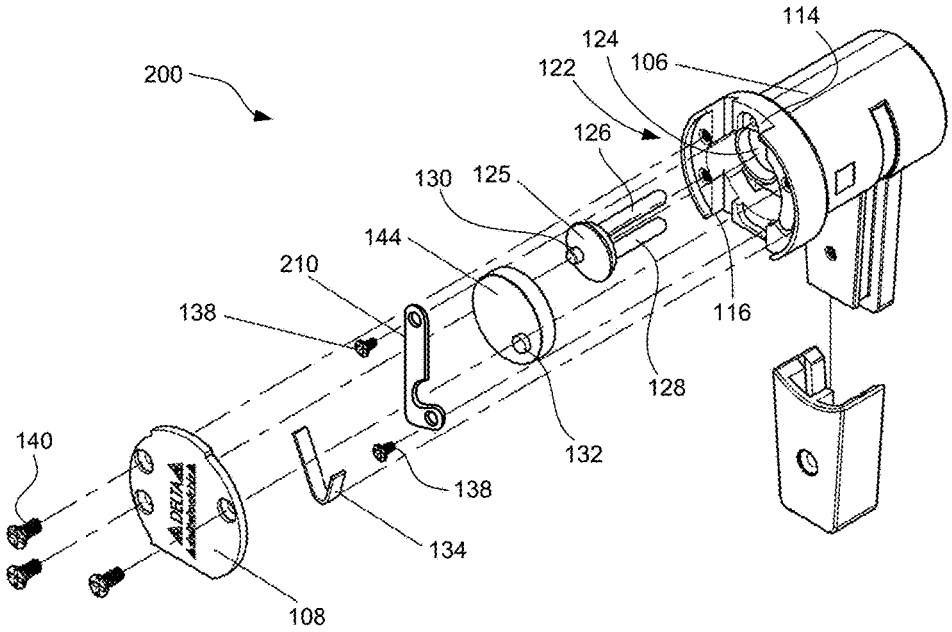
FIG. 19 is an exploded view of a ratchet type locking assembly in accordance with another embodiment of the present disclosure.
Figure 20:
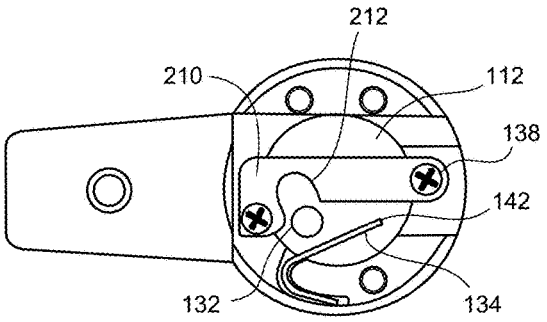
FIG. 20 illustrates a bottom view of the ratchet type locking assembly of FIG. 19 in accordance with the present disclosure.
Figure 21:
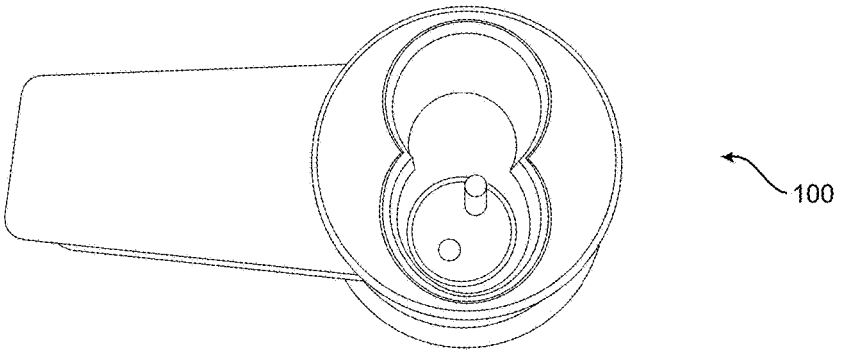
FIG. 21 is a front elevational view of the ratchet type locking assembly of FIG. 14.
Figure 22:
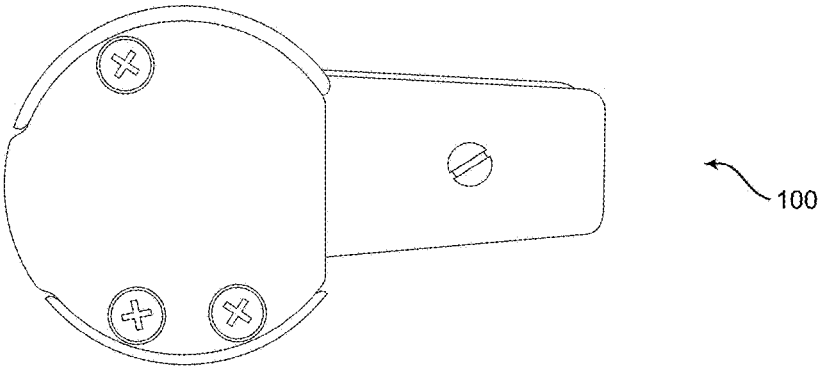
FIG. 22 is a rear elevational view of the ratchet type locking assembly of FIG. 14.
Figure 23:
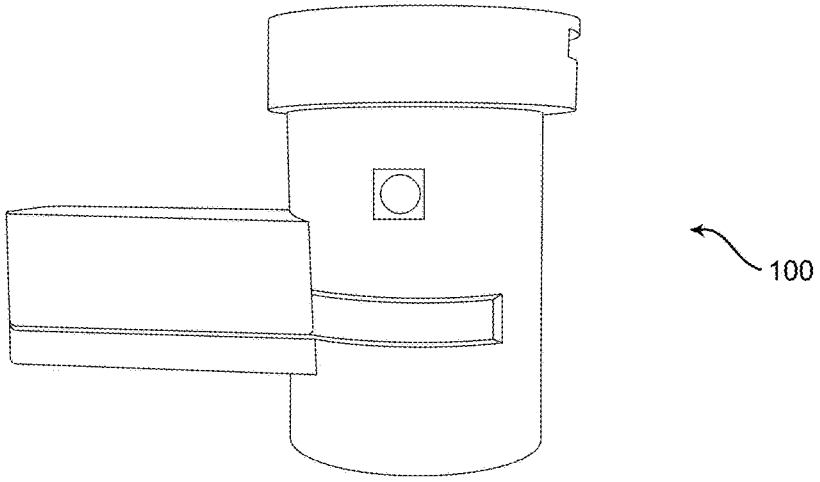
FIG. 23 is a top plan view of the ratchet type locking assembly of FIG. 14.
Figure 24:
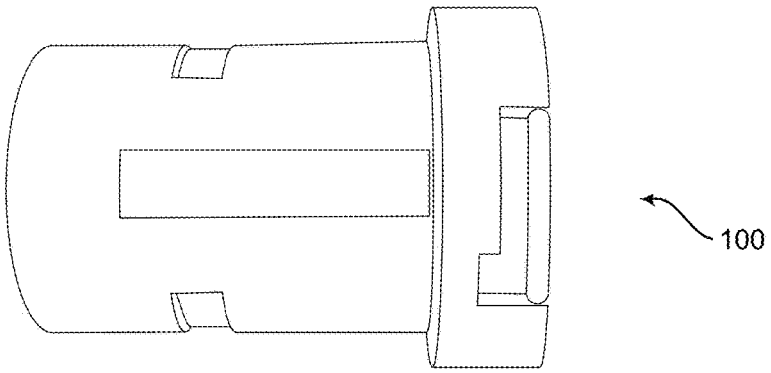
FIG. 24 is a right side view of the ratchet type locking assembly of FIG. 14.
Figure 25:
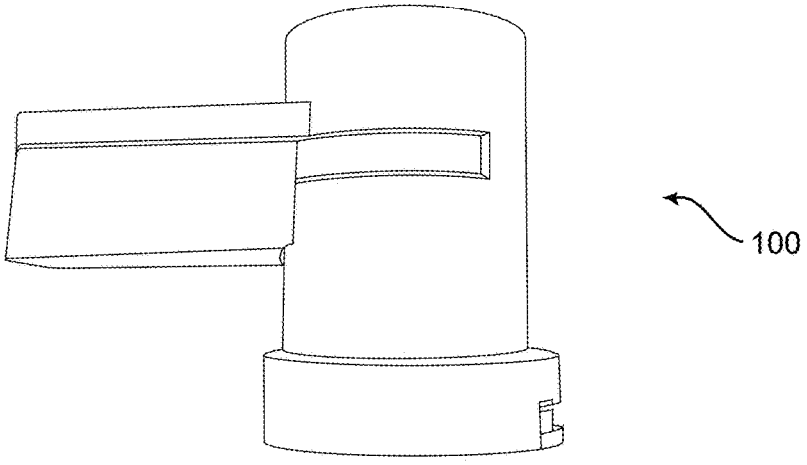
FIG. 25 is a bottom plan view of the ratchet type locking assembly of FIG. 14.
Figure 26:
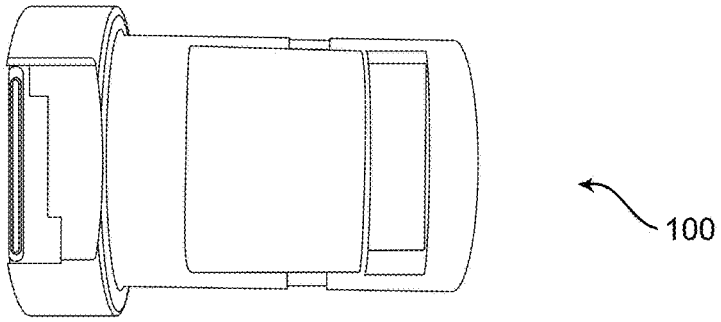
FIG. 26 is a left side view of the ratchet type locking assembly of FIG. 14.

Referring to FIGS. 19 and 20, a ratchet lock assembly 200 of the "interchangeable core" type in accordance with another embodiment of the present disclosure is illustrated. The embodiment of FIG. 19 is similar to the embodiment of FIG. 15 except for a few differences. The bracket 136 shown in FIG. 15 is used to secure the first and second drivers 125, 112. In the embodiment of FIG. 19, this part is replaced with bracket 210. FIG. 20 shows a bottom view of the ratchet lock assembly 200 with the bracket 210 connected to the housing 106 via screws 138. Instead of the "L" shaped bracket 136, the bracket 210 includes a notch 212 that accommodates the second cam 132 to allow a greater range of rotation of the second driver 112. Also, by using bracket 210 having notch 212, the driver 144 shown in FIG. 16 can be used in place of the driver 112 of FIG. 17.

It is to be appreciated that the various features shown and described are interchangeable, that is a feature shown in one embodiment may be incorporated into another embodiment.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims. It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A locking assembly comprising:

a housing including a front portion and a rear portion, the front portion including an aperture revealing an interior of the housing, the rear portion including a recess;

an interchangeable core cylinder disposed through the aperture and mounted within the interior of the housing, the interchangeable core cylinder including a keyway;

a locking bar received by the recess of the housing, the locking bar including a serrated edge;

a spring configured such that, in an unbiased state, the spring selectively engages the serrated edge of the locking bar;

a first driver including a first cam, the first driver coupled to the interchangeable core cylinder;

a second driver including a first surface and a second surface, the first surface opposite to the second surface, the first surface including a groove configured to receive the first cam, the second surface including a second cam extending therefrom; and a bracket disposed in the recess adjacent to the second surface of the second driver and fixedly connected to the rear portion of the housing to secure the first driver and the second driver in the interior of the housing, wherein when an operating key is inserted into the keyway and rotated the first cam rides in the groove of the second driver to rotate the second driver and when the second driver is rotated, the second cam makes contact with the spring to bias the spring away from the serrated edge of the locking bar to allow the locking bar to be withdrawn from the housing.

2. The locking assembly of claim 1, wherein the groove is configured with a first leg and a second leg intersecting at an angle with respect to each other.

3. The locking assembly of claim 2, wherein the first leg and the second leg enable the first driver to rotate at least about 180 degrees thus enabling the a key inserted into the keyway to also be rotated at least about 180 degrees.

4. The locking assembly of claim 3, wherein the keyway is configured to receive a rekeying key to perform a rekeying procedure, the rekeying procedure requiring the rekeying key to be rotated at least 180 degrees.

5. The locking assembly of claim 1, wherein the bracket includes a notch configured to receive the second cam to allow for a greater rotational range of motion for the second cam.

6. The locking assembly of claim 5, wherein the notch of the bracket enables the first driver to rotate at least about 180 degrees thus enabling a key inserted into the keyway to be rotated at least about 180 degrees.

7. The locking assembly of claim 6, wherein the keyway is configured to receive a rekeying key to perform a rekeying procedure, the rekeying procedure requiring the rekeying key to be rotated at least 180 degrees.

8. The locking assembly of claim 1, wherein the interchangeable core cylinder is a small format interchangeable core.

9. The locking assembly of claim 1, wherein the locking bar includes a hook disposed on an end of the locking bar.

10. The locking assembly of claim 1, wherein the interchangeable core cylinder is front-loaded.

* * * * *